US005493941A

United States Patent [19]

Verge

[11] Patent Number: 5,493,941

[45] Date of Patent: Feb. 27, 1996

[54] STRINGED INSTRUMENT HOLDER

[76] Inventor: James Verge, 4156 Bellerive, Carignan, Quebec, Canada, J3L 3P2

[21] Appl. No.: 243,693

[22] Filed: May 17, 1994

[30] Foreign Application Priority Data

May 18, 1993 [CA] Canada ..... 2096513

[51] Int. Cl.[6] ..... G10D 3/00

[52] U.S. Cl. ..... 84/327; 403/54

[58] Field of Search ..... 84/327; 403/53, 403/54, 63, 97, 110

[56] References Cited

U.S. PATENT DOCUMENTS 4,144,794 3/1979 Silverman et al. ..... 84/327
4,274,181 6/1981 Schaller ..... 84/327 X
4,715,259 12/1987 Wittman ..... 84/327
4,993,127 2/1991 Mechem et al. ..... 84/327 X
5,000,071 3/1991 Thomas ..... 84/327 X

*Primary Examiner*—Patrick J. Stanzione
*Attorney, Agent, or Firm*—Eric Fincham

[57] ABSTRACT

A holder which is suitable for holding a guitar or like stringed instrument to support the weight while permitting movement of the instrument in at least two and preferably three planes. The device includes a first member attached to the back of the stringed instrument with a second member attached to the belt of the instrument player; the two members are interlocked together in a manner which permits movement of the instrument in at least two planes.

7 Claims, 4 Drawing Sheets

STRINGED INSTRUMENT HOLDER

BACKGROUND OF THE INVENTION

The present invention relates to a holder and more particularly, relates to a holder suitable for attachment to a belt of a wearer for supporting a musical instrument or the like.

Various stringed musical instruments, when played, are held by the player and a supplementary means of support is frequently used. This support usually is in the form of a strap or like and conventionally is used in the case of instruments such as guitars. While the strap, which is attached to two points on the body of the instrument and usually passes over the shoulder of the player does provide some assistance in supporting the weight of the instrument, there are inherent limitations in the capability of the player to completely manipulate the instrument.

It is an object of the present invention to provide a holder for a musical instrument, and which holder permits the instrument player to support the entire weight of the instrument through the holder while at the same time allowing maximum movement of the instrument.

SUMMARY OF THE INVENTION

According to one aspect of the present invention, there is provided a holder for a musical instrument which comprises a first member adapted to be attached to a belt of the player, a second member adapted to be attached to the instrument, each of the members having a cooperating element to interlock said first and second members together in a manner which permits relative movement between the members in at least one plane, at least one of the elements also being adapted so as to be moveable with respect to the balance of the member in a second plane.

In greater detail, the holder of the present invention will be described with respect to the support of a musical instrument and particularly a guitar and with the support being from the belt of the instrument player. It will be understood that other instruments may equally well be supported and it could also be adapted for other types of devices. With respect to the use of a belt, it will be understood that some other arrangement for attachment to an article of clothing or other item worn by the player could be utilized. For example, various forms of harnesses could also be used.

The holder, as above stated, has first and second members which are attached to the belt of the player and the musical instrument respectively. The means of attachment may be any conventional and, for example, in the case of the belt, the first member may include a plate like member secured to the belt and secured to the plate like portion. Suitable means such as a bolt or a screw may be employed.

For attaching the second member to the musical instrument and preferably to the back thereof, mechanical fastening means such as screws may be employed although it is within the scope of this invention to use other fastening means including releasable means be they adhesive or other mechanical interlocking means such as marketed under the trademark "VELCRO".

The first and second members are designed to be interconnected and to this end, a number of different types of interconnections may be employed. It is, however, important that the interconnection be such so as to permit relative movement therebetween in at least one plane although known connection members may also permit movement in more than the one plane. For example, in one embodiment of the invention, a ball and socket joint may be utilized wherein the ball is carried by one of the members with the socket carried by the other. Alternatively, as will be shown in the described embodiments, a shaft and a collar arrangement may equally well be employed.

At least one of the first and second members is designed so as to permit movement in at least a second plane. This, arrangement will allow movement in first and second planes of the musical instrument. Still more preferably, movement in all three planes is provided. The means of providing movement in the second plane may conveniently comprise one of the cooperative interlocking elements being rotatable with respect to the fixed portion of the member. Preferably, the moveable member is the first one—i.e. the one attached to the belt of the player.

The invention also preferably includes means for locking the instrument in one or more positions. To this end, there are a number of known mechanical arrangements which will prevent the moveable members from moving and which locking means are preferably of the easy release type.

BRIEF DESCRIPTION OF THE DRAWINGS

Having thus generally described the invention, reference will be made to the accompanying drawings illustrating an embodiment thereof, in which.

DETAILED DESCRIPTION OF THE INVENTION

Figure 1:
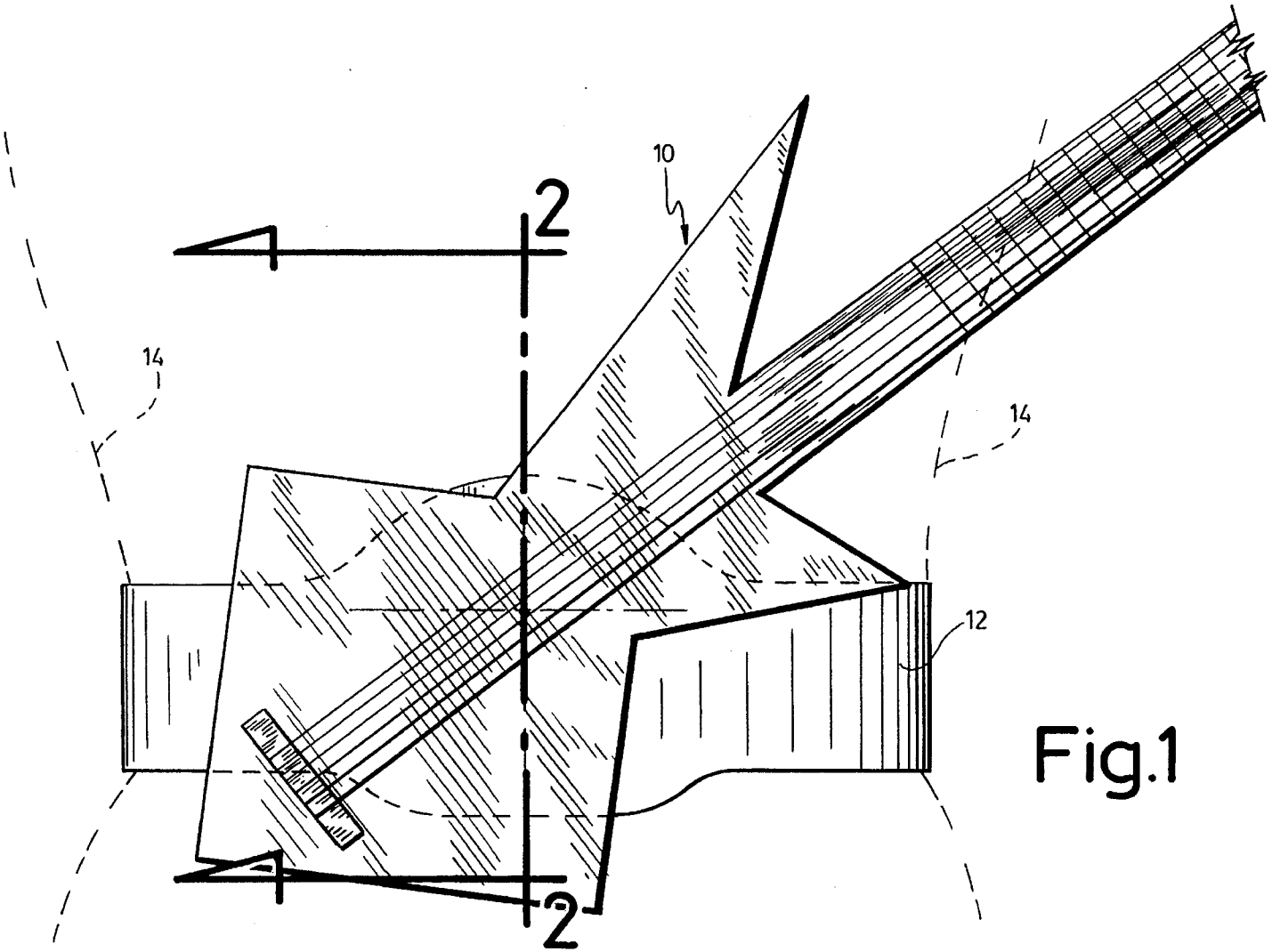
FIG. 1 is a front view of a musical instrument and belt.

Referring to the drawings in greater detail and by reference characters thereto, in FIG. 1 there is illustrated in dotted line 14, an instrument player wearing a belt 12 to which is secured a guitar 10.

Figure 2:
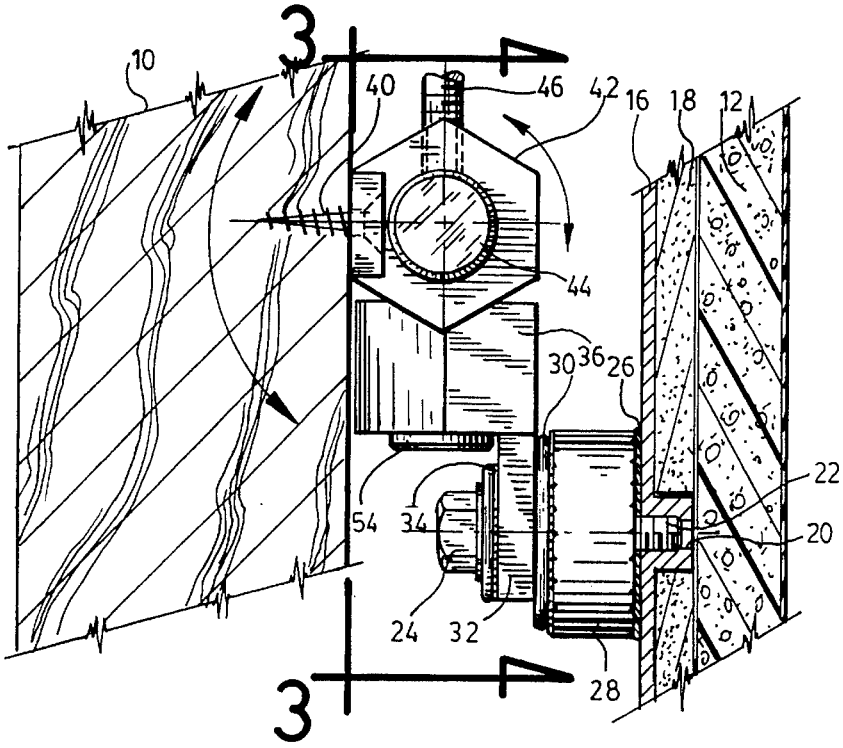
FIG. 2 Is a cross sectional view taken along the lines 2—2 of FIG. 1.
Figure 3:
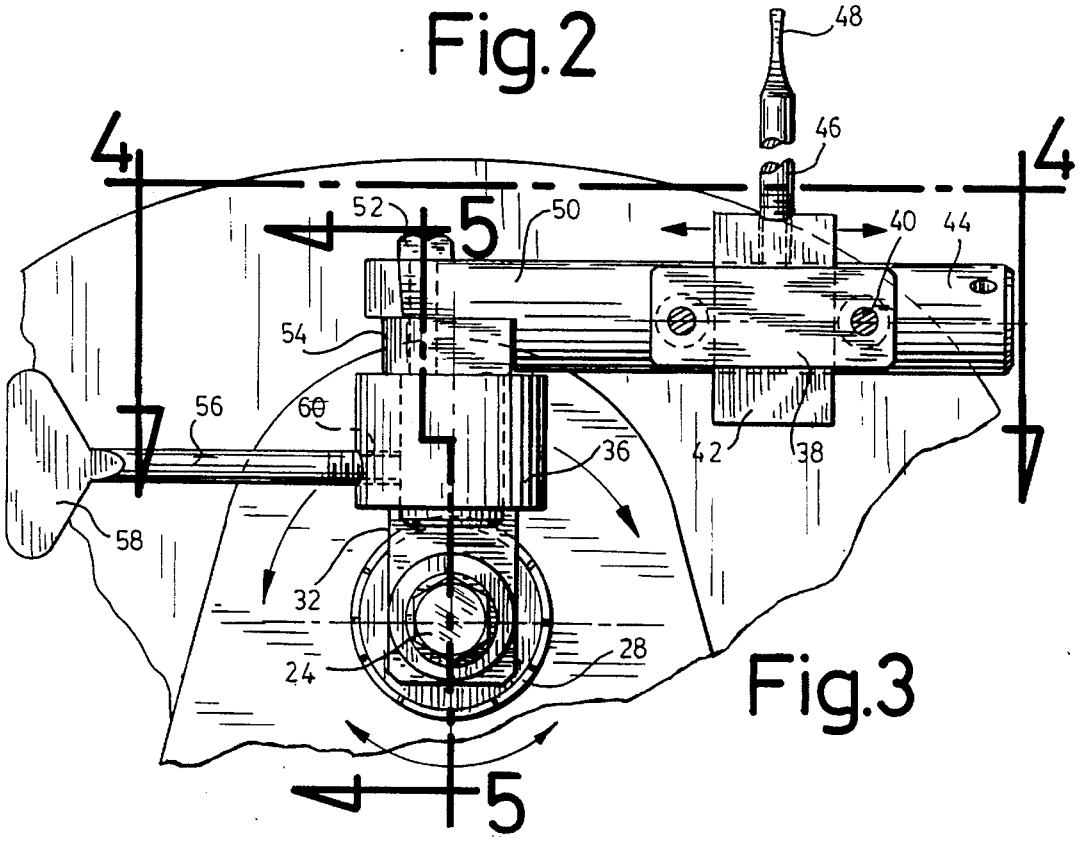
FIG. 3 is a sectional view taken along the lines 3—3 of FIG. 2.
Figure 4:
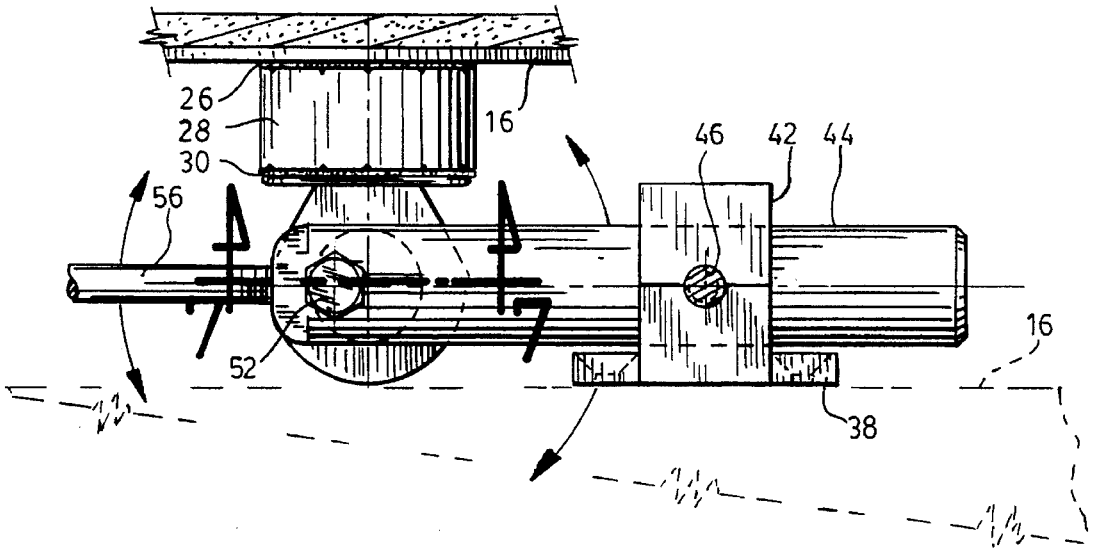
FIG. 4 is a sectional view taken along the lines 4—4 of FIG. 3.
Figure 5:
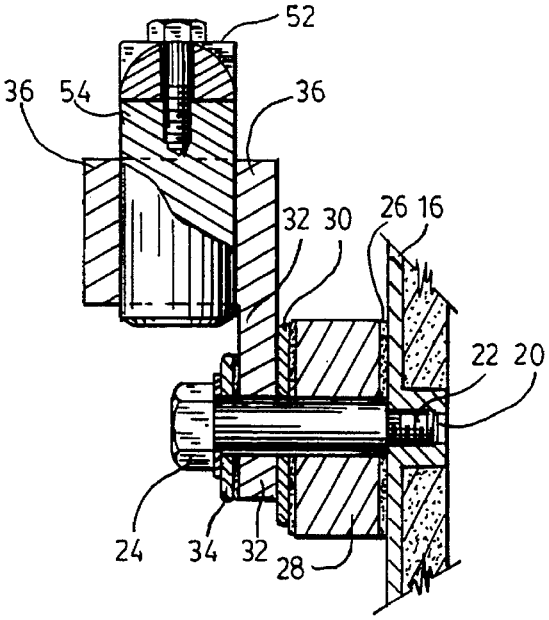
FIG. 5 is a sectional view taken along the lines 5—5 of FIG. 3.
Figure 6:
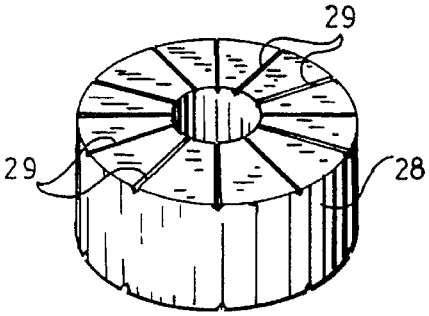
FIG. 6 is a perspective view of a spacer member.
Figure 7:
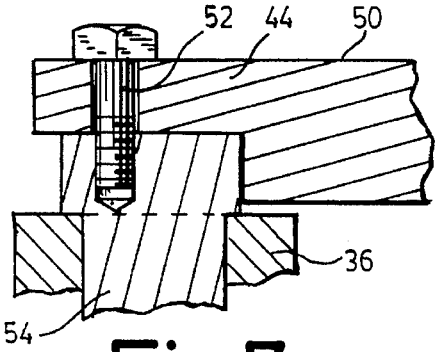
FIG. 7 is a sectional view taken along the lines 7—7 of FIG. 4.

As shown in FIGS. 2 and 3, a plate 16 is secured by adhesive 18 to belt 12. Plate 16 has a screw threaded cavity or inset generally designated by reference numeral 20 into which is screw threadably engaged a screw 22 having a head 24. Held in place by screw 22 is a washer 26, a spacer 28 having grooves 29 (see FIG. 4) formed therein, a washer 30 and a flange like member generally designated by reference numeral 32. A further washer 34 is interposed between head 24 and flange 32.

Flange 32 is rotatable with respect to plate 16 and is integrally formed with a collar 36 which has an aperture extending therethrough.

To the back of guitar 10 there is secured a plate member 38 by means of screws 40. Plate member 38 has formed therewith a second collar member 42 having an aperture formed therein to receive a shaft 44. Shaft 44 is thus rotatable within the aperture of collar 36 and the rotation may be made easier or tighter by means of a tightening screw 46 having head 48 thereon. Tightening screw 46 is adapted to exert pressure on shaft 44 to permit or stop rotation of the shaft within collar 42.

Shaft 44 has, at one end thereof, a flat portion 50 to which is secured a second shaft 54 by means of a machine screw 52. Shaft 54 is adapted to fit within collar 36 which, as previously discussed, is formed with flange member 32. A tightening screw 56 having a head 58 is screw threadably engaged with aperture 60, shown in FIG. 3, to loosen or tighten the degree of ease of rotation of shaft 54.

Thus, as may be seen from the above, there is provided an arrangement wherein movement of the guitar relative to the guitar player is permitted in the three different planes. Referring to the normal orientation of the guitar and player, rotation of flange 32 about screw 22 permits rotation in the vertical plane such that the neck and body of the guitar may be moved upwardly and downwardly. The rotation of shaft 54 in collar 36 permits rotation in a horizontal plane while the rotation of shaft 44 in collar 42 permits rotation in a third plane. Also, as may be seen from FIG. 3, the length of shaft 44 permits movement of collar 42 in a horizontal direction as indicated by the arrows to provide for a comfortable position for the guitar player.

Figure 8:
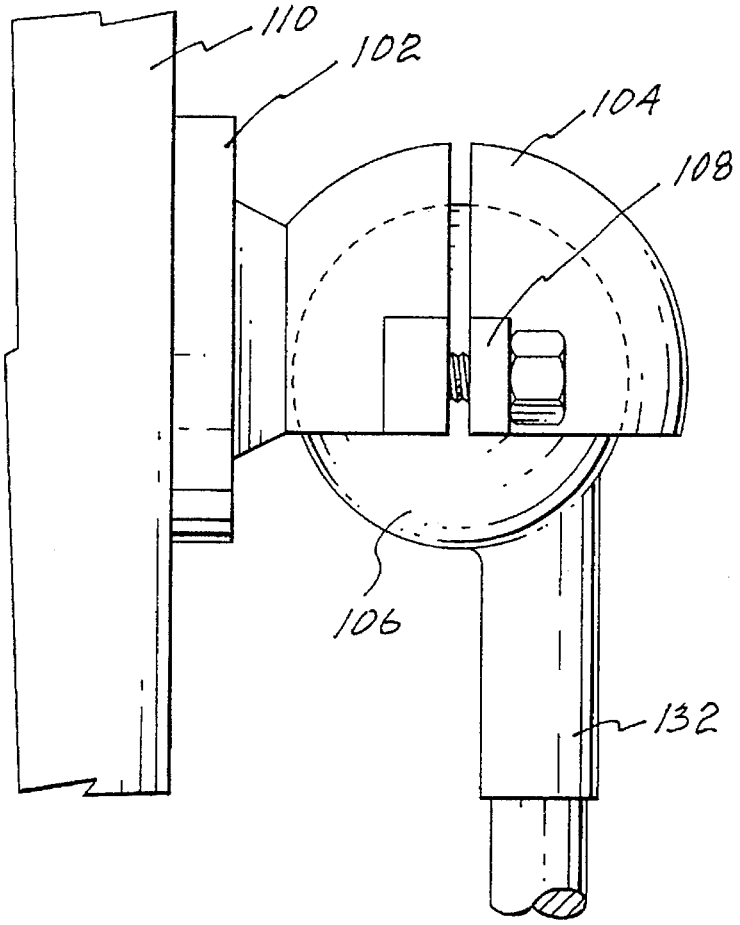
FIG. 8 is a side view of an alternative arrangement of an interlocking means according to the present invention.

In a further embodiment of the invention illustrated in FIG. 8, a guitar 110 has a plate member 102 attached thereto and to which plate member there is provided a socket arrangement 104. Socket 104 is adapted to receive a ball 106; in this respect, socket 104 may have a bolting arrangement generally designated by reference numeral 108 to permit insertion of ball 106 and to tighten or loosen the same.

Ball 106 has a shaft 110 extending outwardly therefrom, and which shaft would be secured to the belt of the player in a manner similar to that of flange 32 of the embodiment of FIGS. 1 to 7. In other words, the flange has an aperture 112 and a screw would secure the same to the belt while permitting movement in the vertical plane.

It will be understood that the above described embodiments are for purposes of illustration only and that changes and modifications may be made thereto without departing from the spirit and scope of the invention.

What is claimed is:

1. A device for use with a stringed instrument, said device comprising a first member having attachment means for attaching said member to a first substrate, a second member having attachment means for attaching said second member to a second substrate, an interconnecting assembly having first and second connecting means, said first connecting means being connected to said first member so as to permit movement therebetween in a first plane, said second connecting means being connected to said second member so as to permit movement therebetween in at least two planes, said two planes being different planes from said first plane.

2. The device of claim 1 wherein said first substrate is a belt and said second substrate is a stringed instrument.

3. The device of claim 2 wherein said first member includes a shaft portion, said first connecting means being connected to said shaft portion and being rotatable thereabout to thereby permit movement therebetween in said first plane.

4. The device of claim 3 wherein said second connecting means comprises a ball and socket assembly.

5. The device of claim 1 wherein said second connecting means includes a shaft and a collar, said shaft being rotatable within said collar to thereby permit movement in a second plane, said shaft being rotatably connected to said first connecting means to thereby permit movement in a third plane.

6. The device of claim 5 wherein said shaft is moveable in a longitudinal direction within said collar to permit adjustment thereof.

7. A device for securing a stringed instrument to a waist belt that is attached to a wearer's waist, the device comprising a first member attached to said belt, said first member having a shaft associated therewith, a second member attached to a rear surface of said stringed instrument, an interconnecting assembly having a first connecting means connected to said shaft of said first member, said first connecting means permitting rotatable movement about said shaft, a second connecting means connected to said second member so as to permit movement in at least two planes.

* * * * *